US005416814A

United States Patent [19]

Gibbs et al.

[11] Patent Number: 5,416,814

[45] Date of Patent: May 16, 1995

[54] ELAPSED TIME RECORDING DEVICE

[75] Inventors: Terence K. Gibbs, Stubbington; Graham Luck, Hants; David J. Eagle, Kilmacolm, all of United Kingdom; Andrew J. Morrish, San Jose, Calif.; Valerie Findlay, Glasgow, Scotland

[73] Assignee: International Business Machines Corporation, Armonk, N.Y.

[21] Appl. No.: 97,473

[22] Filed: Jul. 26, 1993

[30] Foreign Application Priority Data

Jul. 25, 1992 [GB] United Kingdom ..... 9215896

[51] Int. Cl.[6] ..... G06M 3/00

[52] U.S. Cl. ..... 377/20; 377/15; 368/9; 327/265

[58] Field of Search ..... 377/15, 20; 328/129.1; 368/9

[56] References Cited

U.S. PATENT DOCUMENTS

| | | | |
|---|---|---|---|
| 4,636,967 | 1/1987 | Bhatt et al. | 377/15 |
| 5,065,084 | 11/1991 | Oogita | 377/15 |
| 5,115,234 | 5/1992 | Levinski et al. | 377/15 |
| 5,313,848 | 5/1994 | Santin et al. | 73/866.2 |

*Primary Examiner*—John S. Heyman
*Attorney, Agent, or Firm*—Martin J. McKinley

[57] ABSTRACT

An elapsed time recording device includes a counter (130) for incrementally advancing a count value from an initial value towards and beyond a threshold in response to successive clock pulses of a clock signal. Control logic (140) enables the counter (130) to incrementally advance the count value in response to a first input (pin 3) and a second input (pin 1) being at or near a first voltage level, and holds the count value in response to the first input (pin 3) being at or near a second voltage level and the second input (pin 1) being at or near the first voltage level. Setting logic (210) sets the count value to a value beyond the threshold in response to the first input (pin 3) and the second input (pin 1) being at or near the second voltage level when the count value is between the initial value and the threshold. Because the device consists essentially of electronic circuit elements, it can be implemented in the form of an application specific integrated circuit package suitable for high volume manufacture at relatively low cost. The device is therefore favorable for use in mass produced electrical appliances. Because the count value is immediately advanced beyond the threshold in response to removal of the second input voltage, advance of the count value towards the threshold cannot be prevented or delayed by tampering with pin connections of the device.

10 Claims, 2 Drawing Sheets

ELAPSED TIME RECORDING DEVICE

BACKGROUND OF THE INVENTION

The present invention relates to an elapsed time recording device for cumulatively recording the period during which an electrical appliance is turned on.

Electrical appliances, such as visual display units for computer systems, are turned on and off many times after installation. Therefore, the cumulative period or "Power On Hours" during which such an electrical appliance is actually turned on can be much shorter than the period measured from installation. If the appliance fails after installation, the time to failure can be difficult to determine. This can be extremely frustrating to the purchaser because the warranty period applicable to the appliance may expire before the appliance has been used significantly, or even before the appliance has been turned on after installation.

Conventionally, elapsed time recording devices have been fitted to some electrical appliances with a view to determining the time to failure of the appliances during long term reliability testing. Examples of conventional elapsed time recording devices include mercury timers and motor driven meters. Mercury timers are generally two terminal devices comprising a column of mercury that increases in length as a function of the time during which electrical current passes through it. However, mercury timers are relatively inaccurate. Furthermore, mercury timers are open to fraudulent use because removal of one of the terminals will prevent advance of the column. Therefore, mercury timers are not generally suitable for indicating whether or not the warranty period applicable to an electrical appliance has expired based on the Power On Hours of the appliance. Motor driven meters are relatively expensive because of their mechanical complexity and are therefore unsuitable for use as elapsed time recording devices for electrical appliances produced in high volumes.

SUMMARY OF THE INVENTION

In accordance with the present invention, there is now provided an elapsed time recording device including: a counter for incrementally advancing a count value from an initial value towards and beyond a threshold in response to successive clock pulses of a clock signal; control logic connected to the counter for enabling the counter to incrementally advance the count value in response to a first input and a second input being at or near a first voltage level, and for holding the count value in response to the first input being at or near a second voltage level and the second input being at or near the first voltage level; and setting logic connected to the counter for setting the count value to a value beyond the threshold in response to the first input and the second input being at or near the second voltage level when the count value is between the initial value and the threshold.

Because the device consists essentially of electronic circuit elements, it can be implemented in the form of an application specific integrated circuit package suitable for high volume manufacture at relatively low cost. Therefore, the device is therefore favorable for use in mass produced electrical appliances. Because the count value is immediately advanced beyond the threshold in response to removal of the second input voltage, advance of the count value towards the threshold cannot be prevented or delayed by tampering with pin connections of the device.

Preferably, the counter is nonvolatile subject to continuous application of the second input remaining at or near the first voltage level. Alternatively, the device may further comprise a memory connected to the counter and to the control logic for storing the count in response to the first input being at or near a second voltage level and the second input being at or near the first voltage level.

In a preferred embodiment of the present invention, the device further comprises a serial port and access logic having an input connected to the counter and an output connected to the serial port for reading the count value from the device via the serial port in response to a third input being switched from a first control voltage level to a second control voltage level. This advantageously permits a service engineer to determine the cumulative time for which the appliance containing the device has been turned on.

The device may comprise indicator logic connected to the comparator for actuating an indicator in response to the output signal from the comparator. This advantageously enables a service engineer to determine whether or not to replace the host appliance under warranty or to repair the appliance if the warranty has expired.

The device may also comprise threshold logic connected to the comparator for setting the threshold in response to at least a fourth voltage input being set to one of the first and second control voltage levels. However, the threshold may alternatively be mask programmed into the comparator.

It will be appreciated that the present invention extends to a CRT display comprising such a device, wherein the first voltage input is generated by a power supply of the display and the second voltage is generated by a battery.

DESCRIPTION OF ILLUSTRATIVE EMBODIMENTS

Figure 1:
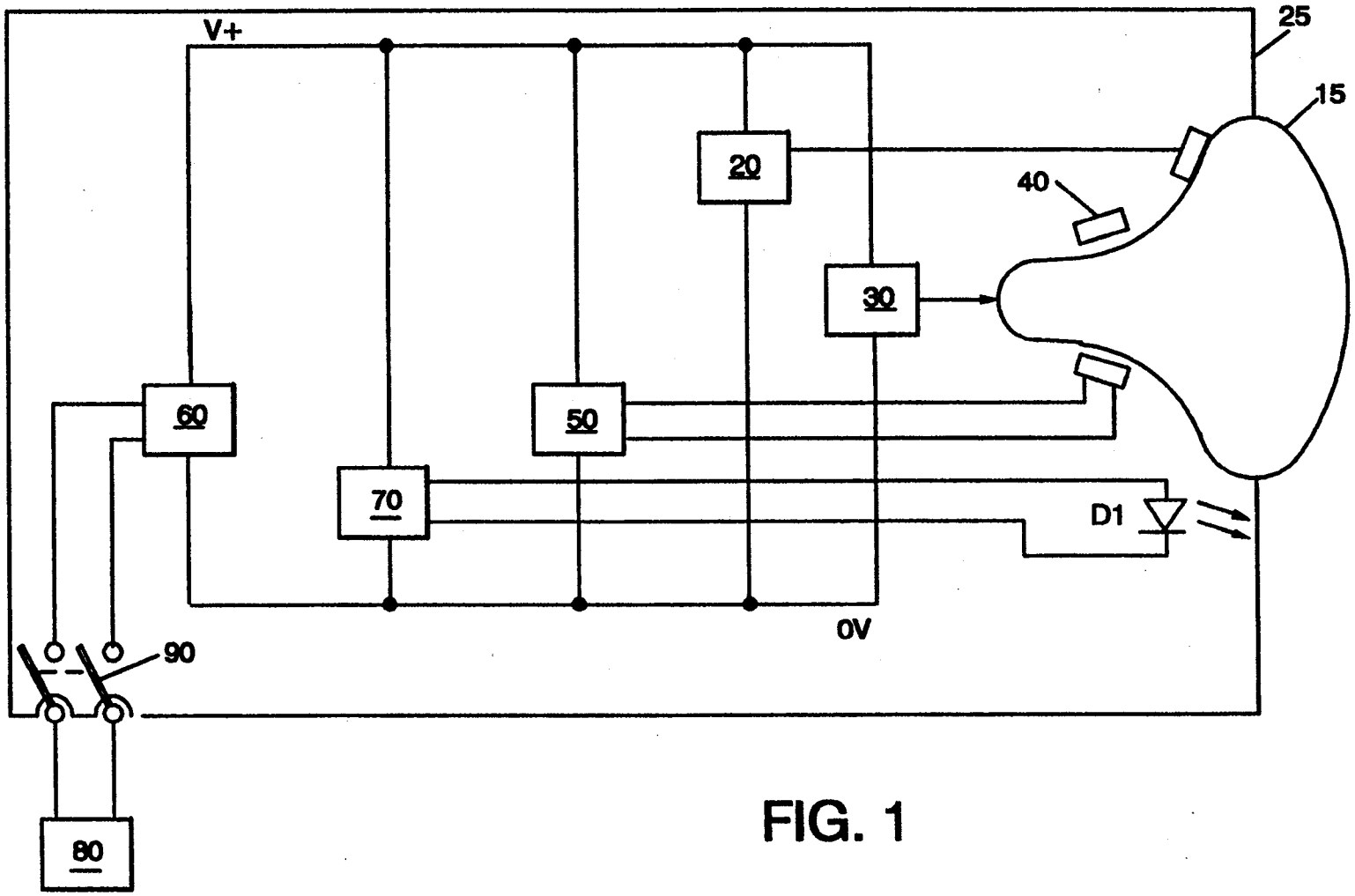
FIG. 1 is block diagram of a visual display unit comprising an elapsed time recording device of the present invention.

Referring first to FIG. 1, a visual display unit 25 comprises a Cathode Ray Tube (CRT) 15 connected to an Extra High Tension voltage (EHT) generator 20 and a video amplifier 30. Line and frame deflection coils 40 are disposed around the neck of the CRT 15. The deflection coils are connected to line and frame deflection circuits 50. A power supply 60 is connected via power supply rails to the EHT generator 20, video amplifier 30 and deflection circuits 50. The power supply rails include +120V, +12V, −12V, 5V and 0V rails collectively represented, for the purpose of explanation, by V+ and 0V. Power supply 60 is connectable to a main electricity supply 80 via a main switch 90. An elapsed time recording device 70 of the present invention is also connected to power supply 60 via power supply lines 5V and 0V. A light emitting diode D1, lamp, or the like, indicates when unit 25 is turned on. In accordance with the present invention, diode D1 is driven by elapsed time recording device 70.

In operation, when unit 25 is turned on at switch 90, power supply 60 draws electrical power from the main electricity supply 80 to satisfy the power demands of EHT generator 20, video amplifier 30, and deflection circuits 50. EHT generator 20 generates an electric field within CRT 10 for accelerating electrons in one or more beams towards the screen of CRT 10. Line and frame deflection circuits 50 generate varying magnetic fields for scanning the electron beams across CRT screen 10 in a raster pattern. Video amplifier 30 modulates the electron beams as a function of input video signals to produce an output display on CRT 10. In accordance with the present invention, elapsed time recording device 70 maintains a cumulative record of the time for which unit 25 has been turned on. During normal operation, elapsed time recording device 70 drives diode D1 continuously to indicate that unit 25 is turned on. However, once the cumulative record exceeds a predetermined threshold, each time unit 25 is turned on, elapsed time recording device 70 initially generates a burst of pulses to flash diode D1 before reverting to normal operation.

Figure 2:
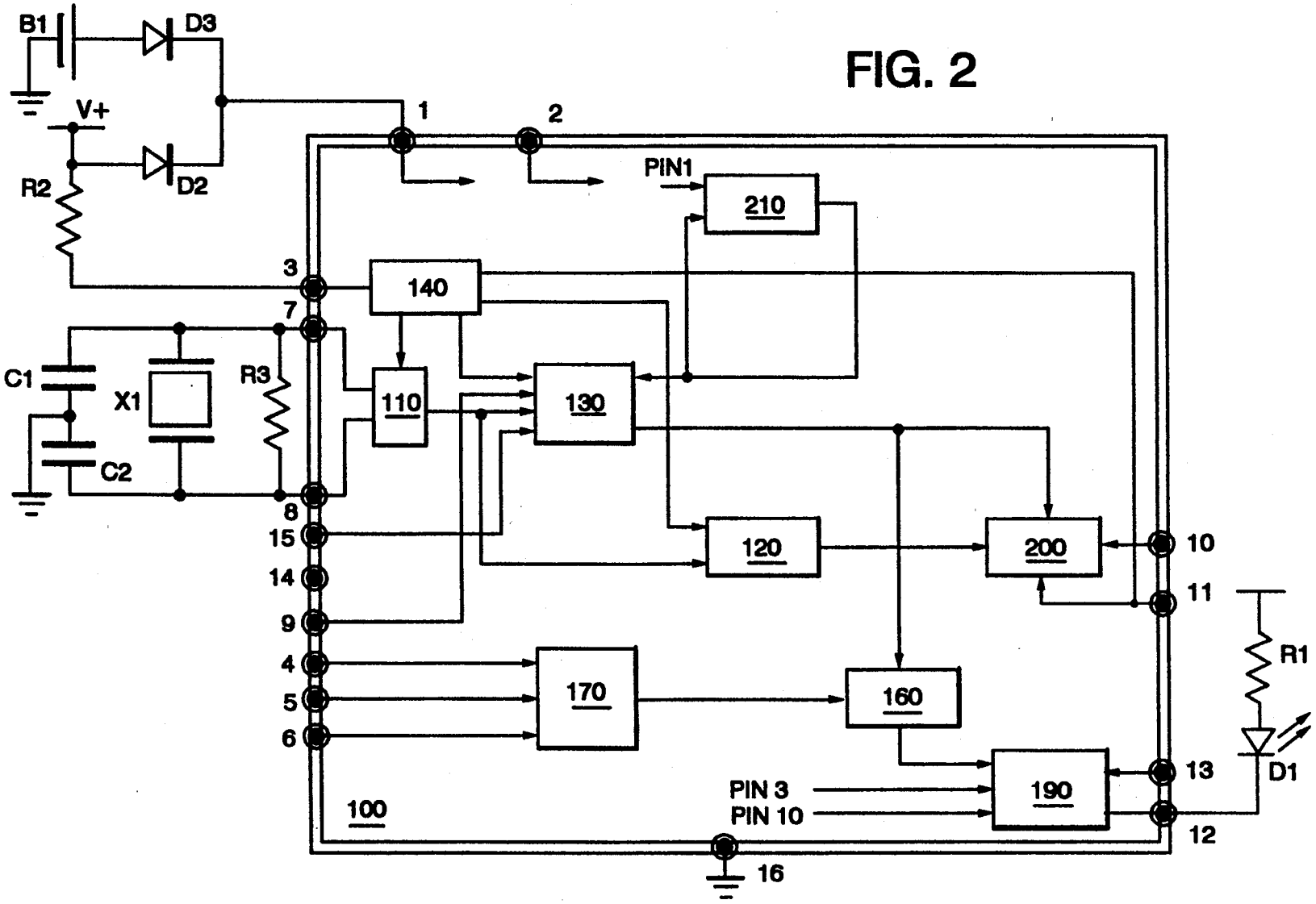
FIG. 2 is a block diagram of an elapsed time recording device of the present invention.

Referring to FIG. 2, elapsed time recording device 70 comprises a 16 pin dual in-line CMOS integrated circuit package 100. Package 100 comprises a clock oscillator 110 having a clock signal output connected to a counter 130 and to a divider 120. Pin 15 is connected to configuration input of counter 130. Counter 130 has a data input connected to pin 9. The oscillator is externally connected, via pins 7 and 8 to a network comprising crystal X1, resistor R3, and capacitors C1 and C2. Control logic 140 receives an input, via pin 3 and resistor R2, from the 5V supply rail V+. Control logic 140 has outputs connected to the enable inputs of counter 130, oscillator 110, and divider 120.

Pin 1 is connected to the 5V supply rail V+ via a diode D2 and pin 16 is connected to the 0V supply power and to package 100. Pin 1 is also connected, via a diode D3, to a battery B1. Battery B1 may be a button cell or similar power source. Internal power connections are omitted from FIG. 2 for clarity.

A 16 bit shift register 200 has a clock input connected to the output of divider 120, and a parallel data input connected to a parallel data output of counter 130. Register 200 has an enable input connected to pin 11. Power can be supplied to the shift register via pin 2.

The parallel data output of counter 130 is also connected to the data input of a digital comparator 160. The reference input of comparator 160 is connected to the output of a threshold decoder 170. Threshold decoder receives a 3 bit parallel input from pins 4, 5, and 6. The output of comparator 160 is connected to indicator logic 190. Indicator logic 190 has test inputs connected to pins 3 and 10, a configuration input connected to pin 13, and an output connected to pin 12. Pin 12 is connected to the +5V supply rail V+ via a light emitting diode (LED) D1 and a resistor R1.

Package 100 further comprises Power On Reset (POR) logic 210 which is connected to pin 1 and to counter 130.

When unit 25 is initially installed, counter 130 is set to zero. In operation, when unit 25 is turned on, power is supplied to package 100 via pins 1 and 16. Oscillator 110 in combination with X1, R3, C1 and C2 generates a clock signal of 32.768 KHz. Clock pulses of the clock signal are counted by counter 130. Counter 130 is arranged to record the cumulative time for which unit 25 has been powered on down to the last second. The 16 most significant bits in counter 130 indicate the number of hours for which unit 25 has been powered on.

When unit 25 is turned off, V+ is removed from pin 3 and D2 cathode. Control logic 140 disables oscillator 110 in response to the removal of V+ from pin 3. The count in counter 130 is retained by the power supplied from B1 via D3 and pin 1. Therefore, counter 130 acts as a non-volatile memory.

When unit 25 is turned back on again, V+ at D2 and pin 3 is restored. Therefore, control logic 140 enables oscillator 110 and counter 130 starts counting again.

Comparator 160 compares the 16 most significant bits in counter 130 with the output from decoder 170. The output of decoder 170, or threshold, determined by hardwiring pin 4, 5 and 6 to either V+ (logic "1") or 0V (logic "0"). Therefore, the threshold can be preset to any one of eight values. The 16 bit width provides a maximum count corresponding to 65535 hours. Decoder 170 is configured in such a manner that the threshold can be set to one of eight values between 5000 and 50000 hours as a function of the logic states of pins 4, 5 and 6.

If pin 13 is hardwired to logic "1" when the output of counter 130 exceeds the threshold, comparator 160 triggers indicator logic 190 to initially generate a burst of pulses on pin 12 when unit 25 is next turned on, before setting pin 12 to logic "0". The burst of pulses causes D1 to initially flash, thereby indicating to the user that the cumulative time for which unit 25 has been turned on is in excess of the threshold. When pin 12 settles to logic "0" D1 is illuminated continuously as usual. If pin 13 is hardwired to logic "0" the burst of pulses is not generated when the threshold is exceeded and, instead, whenever unit 25 is turned on, D1 remains continuously illuminated. It will be appreciated that, in other embodiments of the present invention, indicator logic 190 may generate the burst of pulses only when the pin 13 is hardwired to logic "0" instead of logic "1".

In other embodiments of the present invention, unit 25 may have a power on indicator separate from D1, and D1 may be located within unit 25 for access only during servicing. It will be appreciated that in such embodiments, indicator logic 190 may be configured to illuminate D1 only when the count in the counters is in excess of the threshold. As mentioned earlier, indicator logic 190 has an output connected to pin 12.

Pin 15 is normally held at logic "1". However, if pin 15 is connected to logic "0" counter 130 is configured to act as a 43 bit shift register. When V+ is applied to pin 1 and pin 15 is connected to logic "0" the clock signal generated by oscillator 110 clocks the logic states applied to pin 9 into counter 130. Therefore, if pin 9 is set to logic "0" counter 130 can be reset It will be appreciated that, in other embodiments of the present invention, pin 15 may normally be held at logic "0" and may be set to logic "1" to configure counter 130 to act as a shift register.

When V+ is removed from D2 cathode, and the 16 most significant bits stored in counter 130 are in excess of the threshold, indicator logic 190 generates a burst of pulses on pin 12 to flash D1 in response to pins 3 and 10 being shorted to logic "0" such as by application of a screwdriver blade or the like. If the count does not exceed the threshold, indicator logic 190 generates a single pulse when pins 3 and 10 are shorted to logic "0". It will be appreciated that, in other embodiments of the present invention, indicator logic 190 may be provoked into similar responses by shorting pins 3 and 10 to logic "1" instead of logic "0". It will also be appreciated that, in other embodiments of the present invention, indicator logic 190 may be provoked into similar responses by shorting combinations of pins other than pins 3 and 10. This advantageously permits a service engineer to determine whether or not the service life of unit 25 has expired.

Shift register 200 serially shifts the current count recorded in the counter out to pin 10 in response to pin 2 being connected to V+ and pin 11 being connected to logic "0". The rate at which the count is shifted out of shift register 200 is determined by oscillator 110 and divider 120. It will be appreciated that, in other embodiments of the present invention, shift register 200 may be configured to serially shift out the current count in response to pin 11 being connected to logic "1" instead of logic "0". Pin 2 can be connected to a power supply independent of V+. Therefore, the count in counter 130 can be read without turning unit 25 on, or even if unit 25 has failed.

If the internal power supply rails of package 100 fall below a predetermined value after the count recorded by counter 130 has advanced from zero, POR logic 210 sets counter 130 to maximum when power in package 100 is restored. Therefore, if B1 is removed in an effort to reset package 100, the 16 most significant bits recorded in counter 130 are automatically set to exceed the threshold. Thus, advance of the count towards the threshold cannot be prevented or delayed by tampering with B1. It will be appreciated that, in other embodiments of the present invention, POR logic 210 may be configured to set the count to a value between its maximum and the threshold determined by decoder 170.

An embodiment of the present invention has been described in the foregoing with reference to a CRT visual display unit. However, it will be appreciated that the present invention is equally, but not exclusively, applicable to other electrical appliances such as liquid crystal displays, computer system units, and printers, as well as domestic goods, such as washing machines, dishwashers, television receivers, video tape recorders and the like.

In the embodiment of the present invention hereinbefore described, the threshold is determined by hardwiring three pins of package 100 to either logic '0' or logic '1'. However, it will be appreciated that in other embodiments of the present invention the threshold may be mask programmed in silicon during fabrication of package 100. It will equally be appreciated that in other embodiments of the present invention, the threshold may be determined by hardwiring greater than or less than three pins to either logic '0' or logic '1' to provide a greater or lesser range of threshold values. Furthermore, in the embodiment of the present invention hereinbefore described, the count in counter 130 advances from zero in response to a clock signal. It will be appreciated, however, that in other embodiments of the present invention the count in counter 130 may advance from an initial value other than zero in response to a clock signal. Still furthermore, it will be appreciated that in other embodiments of the present invention counter 130 may count down from a maximum value, or from some other initial value, in response to a clock signal. In the embodiment of the present invention hereinbefore described, device 70 is in the form of a 16 pin dual-in-line application specific integrated circuit package. However, it will be appreciated that in other embodiments of the present invention device 70 may be in the form of other hermetically sealed circuit packages or may be constituted by several such packages.

We claim:

1. An elapsed time recording device comprising in combination:

a counter for incrementally advancing a count value from an initial value towards and beyond a threshold in response to successive clock pulses of a clock signal, said count value indicative of elapsed time;

control logic connected to said counter for enabling said counter to incrementally advance said count value in response to a first and a second input being at a first voltage level, and for holding said count value in response to said first input being at or near a second voltage level and said second input being at said first voltage level; and setting logic connected to said counter for setting said count value to a value beyond said threshold in response to said first and second inputs being at said second voltage level when said count value is between said initial value and said threshold.

2. The elapsed time recording device of claim 1, further comprising:

a serial port; and access logic having an input connected to said counter and an output connected to said serial port for reading said count value from said counter via said serial port in response to a third input being switched from a first control voltage level to a second control voltage level.

3. The elapsed time recording device of claim 1, further comprising a comparator connected to said counter for generating an output signal in response to said count value exceeding said threshold.

4. The elapsed time recording device of claim 2, further comprising a comparator connected to said counter for generating an output signal in response to said count value exceeding said threshold.

5. The elapsed time device of claim 3, further comprising indicator logic connected to said comparator for actuating an indicator in response to an output signal from said comparator.

6. The elapsed time device of claim 4, further comprising indicator logic connected to said comparator for actuating an indicator in response to an output signal from said comparator.

7. The elapsed time recording device of claim 3, further comprising threshold logic connected to said comparator for setting said threshold in response to a fourth input.

8. The elapsed time recording device of claim 4, further comprising threshold logic connected to said comparator for setting said threshold in response to a fourth input.

9. The elapsed time recording device of claim 5, further comprising threshold logic connected to said comparator for setting said threshold in response to a fourth input.

10. The elapsed time recording device of claim 6, further comprising threshold logic connected to said comparator for setting said threshold in response to a fourth input.

* * * * *